US008365928B1

(12) United States Patent
Lauro

(10) Patent No.: US 8,365,928 B1
(45) Date of Patent: Feb. 5, 2013

(54) GONDOLA STANDARD COVER

(75) Inventor: Richard James Lauro, North Babylon, NY (US)

(73) Assignee: Design Display Group, Inc., Carlstadt, NJ (US)

( * ) Notice: Subject to any disclaimer, the term of this patent is extended or adjusted under 35 U.S.C. 154(b) by 260 days.

(21) Appl. No.: 12/476,825

(22) Filed: Jun. 2, 2009

(51) Int. Cl.
*A47B 57/48* (2006.01)

(52) U.S. Cl. ..... 211/183; 108/108

(58) Field of Classification Search ..... 211/103, 211/187, 189, 191, 207; 108/27, 106, 107, 108/108, 147.17; 248/220.21, 220.41, 220.43, 248/235, 243, 244, 345, 345.1; 405/211, 405/212; 52/36.1, 36.4, 36.5, 46.6, 244, 52/287.1; 5/663
See application file for complete search history.

(56) References Cited

U.S. PATENT DOCUMENTS

| | | | | | |
|---|---|---|---|---|---|
| 891,968 | A | * | 6/1908 | Allen | 248/245 |
| 3,234,897 | A | * | 2/1966 | Berk | 108/152 |
| 3,339,751 | A | * | 9/1967 | Bard | 211/193 |
| 3,342,095 | A | * | 9/1967 | Buntic | 411/508 |
| 3,604,669 | A | * | 9/1971 | Asher | 248/243 |
| 3,685,234 | A | * | 8/1972 | Nelsson | 52/36.6 |
| 3,879,915 | A | * | 4/1975 | Atwater | 403/189 |
| RE28,408 | E | * | 5/1975 | Nelsson | 52/36.6 |
| 3,983,823 | A | * | 10/1976 | McDonnell | 108/147.11 |
| 4,161,853 | A | * | 7/1979 | Weiss et al. | 52/288.1 |
| 4,304,073 | A | * | 12/1981 | Reith | 52/36.5 |
| 4,531,698 | A | * | 7/1985 | Sharber | 248/243 |
| 4,585,131 | A | * | 4/1986 | Crossman et al. | 211/206 |
| 4,869,969 | A | * | 9/1989 | Pavlov et al. | 428/572 |
| 4,886,235 | A | * | 12/1989 | Thornborrow | 248/224.8 |
| 4,898,285 | A | * | 2/1990 | Field | 211/183 |
| 4,966,343 | A | * | 10/1990 | Bessinger et al. | 248/243 |
| 5,004,198 | A | * | 4/1991 | Jager | 248/224.8 |
| 5,004,201 | A | * | 4/1991 | Bessinger | 248/243 |
| 5,069,408 | A | * | 12/1991 | Bessinger | 248/250 |
| D323,452 | S | * | 1/1992 | Stumpf et al. | D8/381 |
| D345,499 | S | * | 3/1994 | Padilla | D8/381 |
| 5,301,437 | A | * | 4/1994 | Burke | 33/562 |
| 5,348,385 | A | * | 9/1994 | Berg | 312/247 |
| 6,205,625 | B1 | * | 3/2001 | Kato | 24/297 |
| 6,293,507 | B1 | * | 9/2001 | Gorniak | 248/243 |
| 6,644,609 | B1 | * | 11/2003 | Scott | 248/243 |
| 6,712,229 | B2 | * | 3/2004 | Fritsche et al. | 211/189 |

* cited by examiner

*Primary Examiner* — Darnell Jayne
*Assistant Examiner* — Joshua Rodden
(74) *Attorney, Agent, or Firm* — Andrew S. Langsam; Pryor Cashman LLP

(57) ABSTRACT

A gondola standard cap comprises a relatively long and flat front wall with smooth and backwardly curved side edges. The gondola standard cap is provided on its rear with vertically aligned and spaced resilient ears which allow the cap to be installed into the holes of vertical posts in metallic shelving systems. The cap is provided with a plurality of vertically aligned knock-out tabs which are selectively removed as needed for alignment with the holes of the vertical post of the metallic shelving system to accommodate the ears of the brackets of the shelving system. In this way, the gondola standard cap will close off the holes of the vertical posts and prevent any injury by contact with the holes of the posts.

18 Claims, 4 Drawing Sheets

GONDOLA STANDARD COVER

BACKGROUND OF THE INVENTION

The present invention relates to a removable cap for the inwardly directed end of a vertical post of a set of metal frames forming shelving. The shelving is very often seen in "big box" stores, warehouse-styled clubs, and, of course, within warehouses, all to store and/or display merchandise. The caps are molded plastic inserts that are forced into the holes of the opposed vertical posts (where shelf brackets elements are otherwise inserted) and block off the exposed holes on the vertical posts from fingers being accidentally inserted and also from dust and other accumulation gaining entry within the hollow vertical chamber of the posts. The back of the plastic cap is provided with at least two pairs of opposed resilient ears which are capable of being squeezed together as the face on the cap is pressed onto the posts. When the ears pass through the holes of the vertical posts their resiliency allows them first to compress and pass between the edges of the hole and then when the maximum distance between opposed ears of a pair pass through the hole, the resiliency "pops" them back to their original spread apart configuration. The ears are thus held within the posts and the cap to the face of the post, i.e., the cap is held flush against the outside wall (yet facing inwardly) of the posts. This secures the cap to the post. Also, the cap is provided with a series of vertically spaced knock-out tabs which are aligned with the holes of the vertical posts of the shelving system. Only those tabs which are aligned with the holes of the post which are meant to support the shelf brackets of the shelving system are removed from the cap. Thus, the other tabs remain and block off the other open holes of the vertical posts. This prevents little fingers (children often shop with their parents in the "big box" stores) and dust and debris from accumulating within the hollow chamber of the vertical posts since access is blocked thereto by the closing off of the holes of the post by the cap and the remaining tabs, except those holes of the post and the cap which are aligned and unblocked for receipt of the shelf brackets.

DESCRIPTION OF THE PRIOR ART

Large metal shelving is provided in a variety of environments. For example, big box stores, like Wal*Mart; Sam's; Best Buy; Costco; etc. use large warehouse-like space and display merchandise to the consuming public by placing the same on large metallic shelving systems. The systems are somewhat convertible and adaptable to the merchandise in that the height of the horizontal shelves can be adjustably located by adjusting the brackets of the system. More specifically, to construct a typical metal shelving system four vertical posts are provided. The posts are supported by truss members, on the two outside "walls," across the back and often just raised above the floor of the warehouse. Then, support brackets are placed into vertically aligned holes of the four posts. The brackets extend from the left set of vertical posts to the right set of vertical posts by fitting into the opposed faces of the vertical posts. The brackets often have downwardly extending tabs which slide into and then downwardly into the holes of the vertical posts and are maintained there by a combination of gravity, the weight of the brackets and the geometry of the interengagement of the brackets and the holes of the vertical posts. The brackets, extending across the front and the rear of the four, suitably spaced and aligned vertical posts, provide horizontal support surfaces for shelves. If properly installed, the shelves are horizontal and supported by the brackets. The merchandise for display is then appropriately placed on the shelves for sale.

The vertical posts of the typical warehouse metallic shelving system are often provided with a plurality of vertical aligned and spaced holes, to allow for variability of the location of the shelf brackets and the location where their tabs can be placed into and within the holes so as to adjust the location of the brackets and the supported shelves. The person(s) assembling the shelving system will select the holes through which each of the ears of the brackets will pass so that when the brackets are installed, the ears pass through the open holes of the vertical posts and hold the bracket in place. Of course, an able assembler will easily identify those holes which are aligned on opposed posts so that the brackets, when installed, will be horizontal so that the shelving, when placed on the brackets, will be level. This ensures that the merchandise will not accidentally fall off or slide on of the shelving.

Often, the metallic shelving, first installed for a first type of merchandise is called upon to store, display and hold new and different merchandise. The assembler will then merely remove the horizontal shelf, remove the four opposed brackets and then use a new set of holes and place the brackets' tabs within them at the new height desired for placement of the brackets and shelving. Again, the shelves and the merchandise are maintained at a level position because the holes of the posts within which the brackets are now located are preferably aligned.

However, because of the variety of locations and heights for the brackets and shelving, there are a large number of vertically aligned holes in the posts. Since the posts are made of metal, each hole on each post provides an opportunity for a small child to place his/her finger therein to resultant possible injury. With a shelf in position, at a first height, there are now exposed holes corresponding to the other locations for the brackets. Those holes, formed from metal, can be attractive to small children to place their fingers therein. Obviously, the metallic burrs of the edges or walls of the holes are rough and if a child places his/her finger therein and then remove the same, the child's finger can be easily cut. Clearly this is a result desirably avoided by both child, parent and store owner.

The present invention is a gondola standard cap, a molded piece of plastic, which will fit on the vertical posts and cover the exposed and unused holes of the vertical post. The soft plastic of the pavilion cap has far smoother walls and the running of a finger thereover by a child will not result in a finger cut.

The gondola standard cap of the present invention also serves to block off the hollow inside of the vertical posts. This will minimize injuries and also prevents unintended objects, dust, gum, paper, etc., from being shoved into the openings, accumulating within the vertical chamber of the inside of the posts and creating a possible health and unsightly hazard.

The prior art consists of metal shelving systems comprising vertical posts, trusses to hold the posts aligned and vertical; the vertical posts having aligned and vertically-spaced holes in inwardly directed and opposed faces, for holding a set of brackets for shelving. As mentioned, the vertically aligned and spaced holes of the posts are "open" and provide sharp metal edges for injury and openings into the hollow vertical inside of the posts. The present invention is a plastic cap which covers the holes until they are needed by relocation of the brackets.

The gondola standard cap has a set of knock-out tabs which when removed reveal aligned vertical holes corresponding to the size, spacing and location of the holes of the vertical posts. If a bracket is desirably relocated (or originally located) the corresponding knock-out tabs are removed and the bracket's ears or tabs slid within and through the exposed holes of the gondola standard cap and the holes of the post located behind them. Thus, most of the metallic holes of the vertical posts are covered by the plastic, vertical pavilion cap until the holes are exposed by removing the knock-out tab of the corresponding holes of the gondola standard cap.

Although not actually seen by the inventor, it could actually occur to those of skill in the art to block the holes of the vertical posts with tape or moldable clay so as to prevent injury by contact by children's fingers and the rough, side edges of the holes of the posts. The present invention provides an attractive, convenient, quick and very safe manner of ensuring that substantially all originally exposed holes of the vertical posts are blocked so that no injury should result. The gondola standard cap can be fabricated (molded) in a variety of lengths but it is expected that a single length will accommodate most standard metallic shelving installations since they are generally constructed at regular shelf heights, meaning that the number of exposed holes in the vertical posts are relatively standard, both above and below the installation location of the brackets for the shelves.

SUMMARY OF THE INVENTION

The present invention is a plastic molded cap which fits over one surface (the inwardly directed face with the vertically aligned and spaced set of holes) of the vertical post. Ideally, one (or multiples of the plastic cap) extend between vertically spaced shelves. The plastic caps can be easily molded in lengths so that one or more will precisely cover the standard distance between one shelf and a vertically aligned and spaced above and/or below located shelf. The gondola standard cap, a plastic molded component, is about the width of the surface of the vertical post and is provided with gently outwardly sloped vertical edges, not hard edges. The smooth curvature ensures a problem- and injury-free contact surface should a child or adult come into contact therewith.

The back of the gondola standard cap is provided with one or more sets of resilient ears which can easily be squeezed together (when the cap is pushed onto the face of the post) to allow the ears of the device to be forced into exposed holes. The ears on the back of the cap then assume (a consequence of the resiliency) their original spaced distance and the geometry of the ears hold the cap onto the face of the vertical post. Preferably, two or more sets of vertically spaced ears are provided to the rear or back surface of the cap so that the cap will snugly fit upon and to the face of the vertical post. As mentioned, the gondola standard cap is located on the inward facing wall of the vertical posts, the wall thereof which is adapted to accept the tabs of the support brackets.

The gondola standard cap is provided with vertically spaced and aligned knock-out tabs and defined holes, a consequence of the selective removal of the tabs. These are removed as desired when a bracket for the shelving system is desired at a particular location of the metallic vertical posts. The installer will knock out the tabs of the plastic cap and expose the holes of the gondola standard cap which are substantially aligned with the holes of the vertical post to which the gondola standard cap is secured. The tabs of the bracket will then be capable of being extended through both the gondola standard's cap's, now-open holes and the aligned holes of the vertical post. When two of the brackets are installed and appropriately aligned, the shelf will be supported for use and the non-used holes for the tabs of the brackets will be covered, no longer providing an opportunity for injury nor accumulation of particles.

If other holes are needed to relocate the brackets of the metallic shelving system, the gondola standard caps can be pulled out and off of the face of the posts. The gondola standard caps can be relocated by installing the ears of the same into different holes of the vertical posts and then new knock-out tabs removed, to remove a new set of holes in the gondola standard cap, so that the brackets can be installed. Of course, the thin, inexpensive plastic gondola standard caps can be simply discarded and a new gondola standard cap used, one with all of its holes intact except for those holes which are to be used by the relocation of the brackets.

DETAILED DESCRIPTION OF THE DRAWINGS AND THE PREFERRED EMBODIMENT

As best seen in FIGS. 1 through 6, the gondola standard cap 10 (hereinafter for ease of reading and brevity often referred to as the "cap") is a molded piece of ABS plastic (although other plastics can be used, of course, as well as other materials) intended for placement onto the inwardly facing wall of each of a set of four vertical posts for a metallic shelving system. The cap is intended to close off from access, until needed, the holes of the vertical posts since those holes are generally rough-edged and can cause injury to a body part (like a finger) when drawn across its surface. The cap 10 is installed by pushing on its front face such that its rear (with resilient flanges and finger elements, described below) push through and are held within the holes of the vertical post P. The knock-out holes 12 of the cap 10 are then removed (or removed before installation) and the exposed hole(s) of cap and post accept the tabs T of the bracket B to be inserted through the holes and into the holes of the vertical post (see FIG. 6) all for the purpose of building a desired metallic shelving system and closing off the unused holes of the post.

Figure 1:
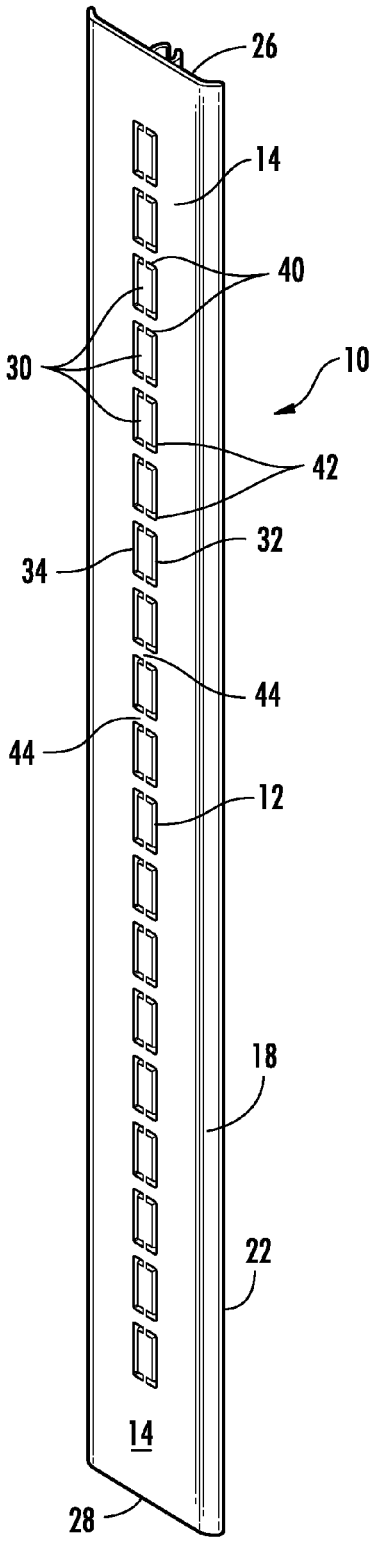
FIG. 1 is a front perspective view of a gondola standard cap, in accordance with the present invention.
Figure 2:
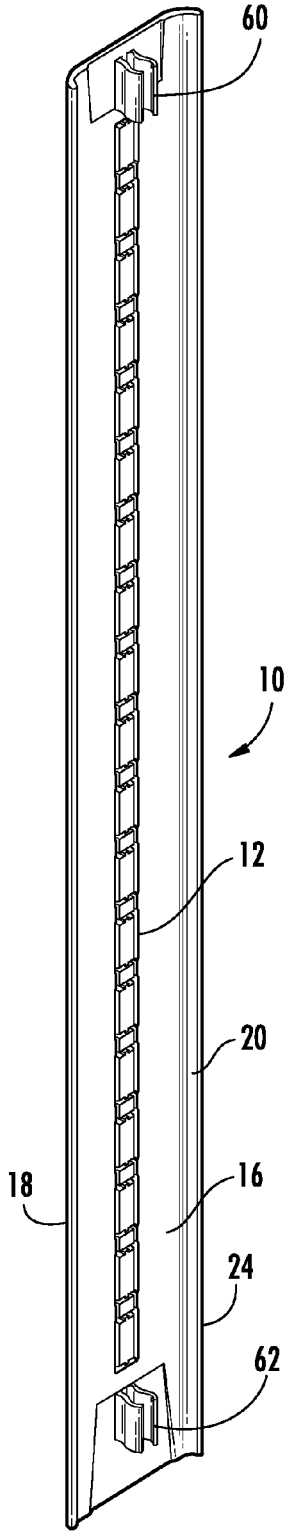
FIG. 2 is a rear perspective view of the gondola standard cap, shown in FIG. 1.
Figure 3:
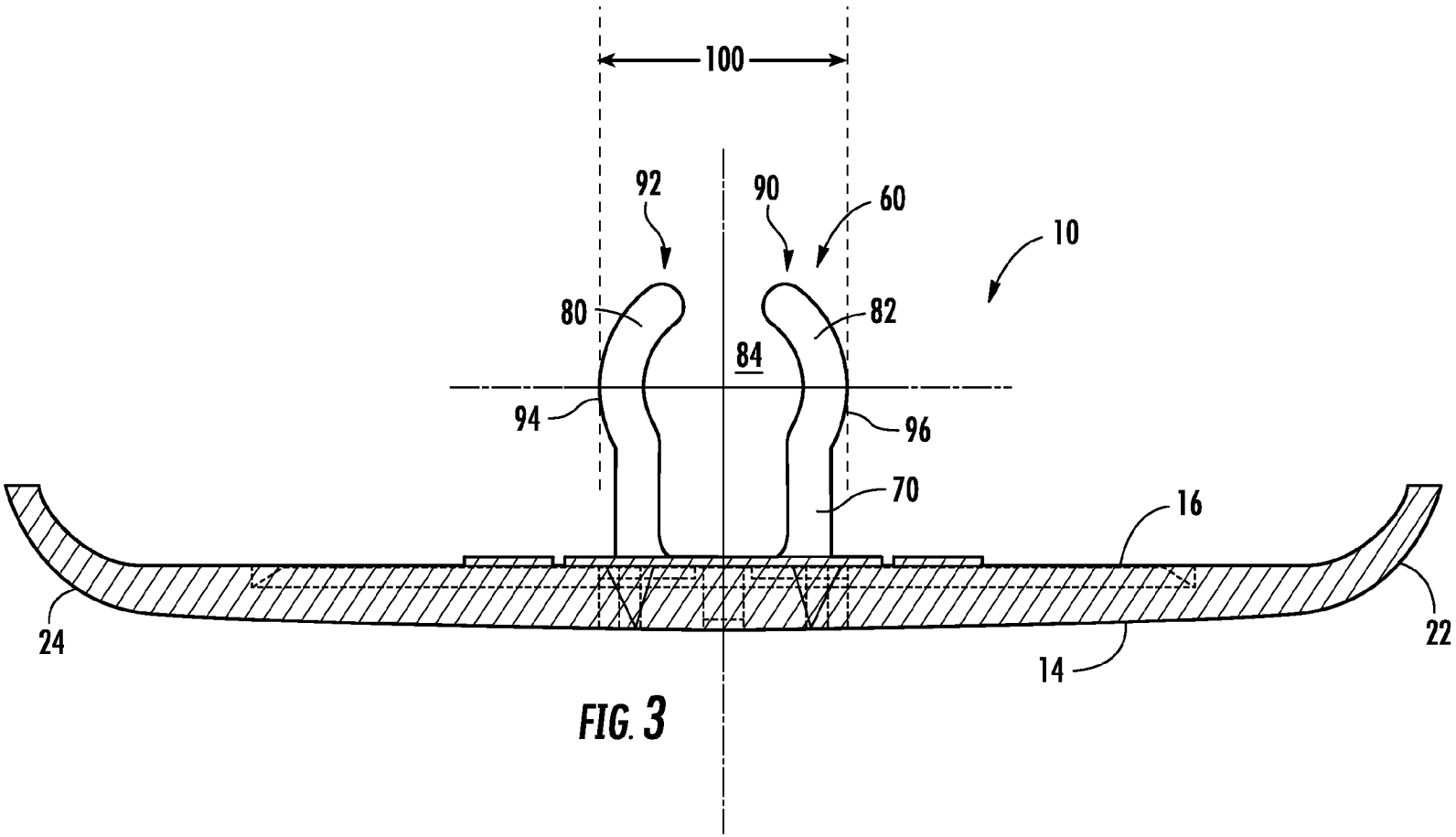
FIG. 3 is an enlarged end plan view of the gondola standard cap shown in FIGS. 1 and 2.
Figure 4:
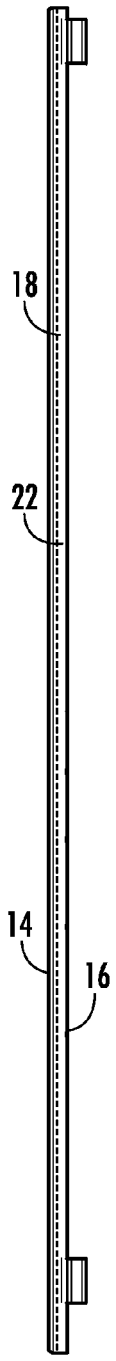
FIG. 4 is a side elevational view of the gondola standard cap show in FIGS. 1, 2 and 3.
Figure 5:
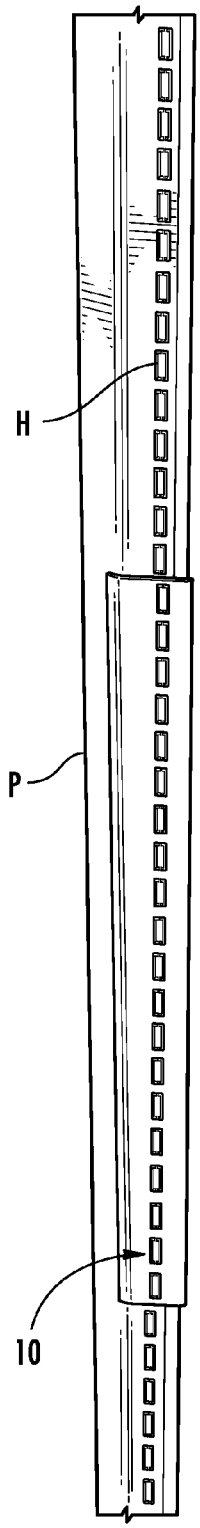
FIG. 5 is front, perspective view of the gondola standard cap of the present invention, secured to an inwardly facing wall of a first vertical post.
Figure 6:
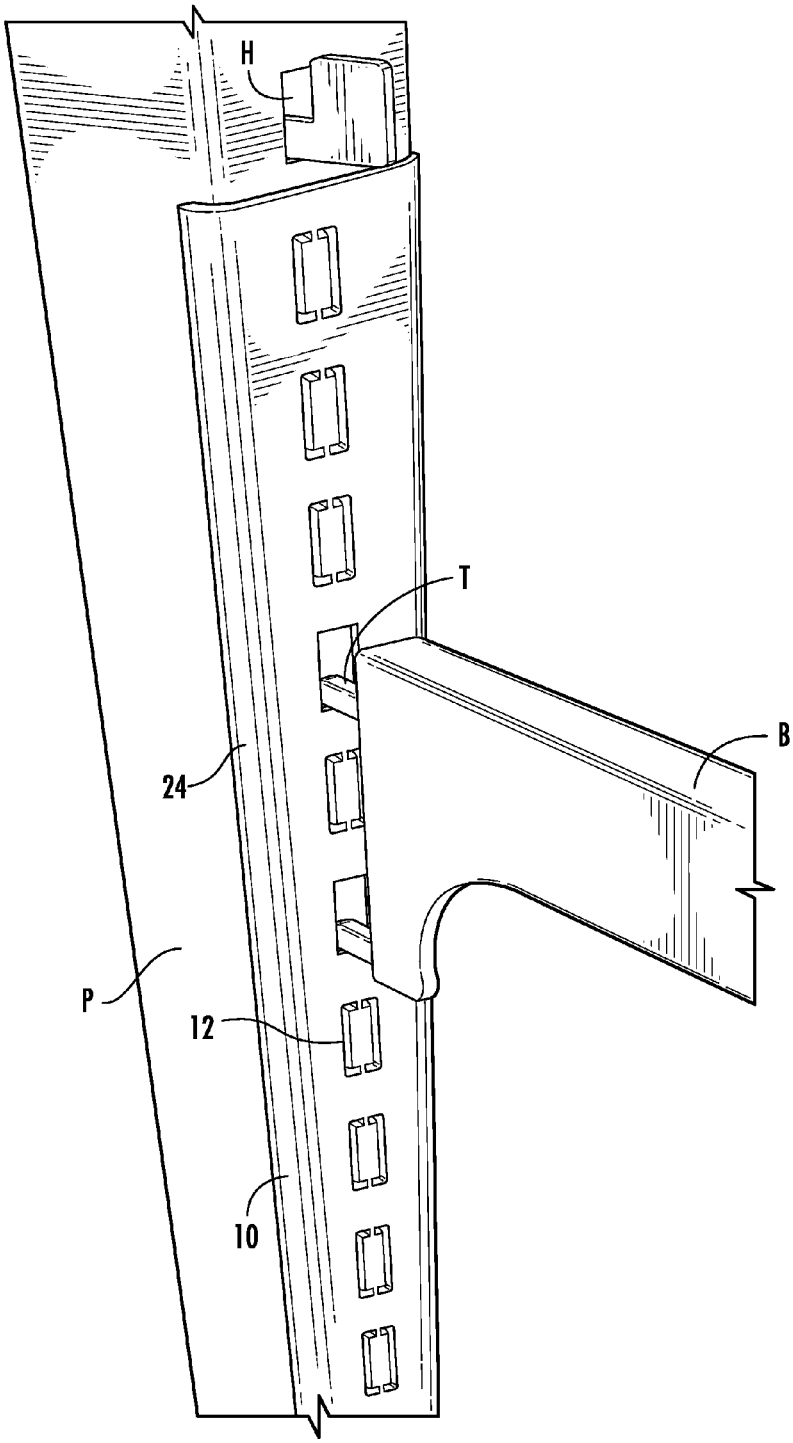
FIG. 6 is an enlarged perspective view of the gondola standard of the present invention installed onto an inwardly directed face of a first vertical post with a first end of a horizontal bracket installed through the exposed and aligned holes of the gondola standard cap and into the holes of the vertical post.

The cap 10 comprises a front face 14, a rear or back 16, and two opposed side edges 18 and 20 which run vertically along the longitudinal axis of the cap. As can be seen in FIGS. 1, 2 and 3, the side edges 18 and 20 comprises rearwardly-flared curved walls 22 and 24, respectively. These ensure that even a sharp edge of the cap is avoided so that a person drawing their hand or finger across the edge 18 and 20 will not become injured. The cap 10 has a top edge 26 and a bottom edge 28. Extending along the length of the cap 10 are a plurality of vertically spaced, knock-out tabs 30 which are defined by a pair of sidewise directed and facing one another, U-shaped slots 32 and 34, passing through the thickness of the cap. The plastic of the cap 10 is sufficiently strong to provide structural integrity to the cap (even with all knock-out tabs 30 removed) and, yet, when a workman pushes on the knock-out tab 30 and twists the plastic about the top 40 and bottom 42 of the tab 30, the knock-out tab 30 will be easily removed and can be discarded, leaving a hole in the cap where the tab was located. Indeed, when two or more vertically adjacent knock-out tabs 30 are removed the small rectangular plastic piece 44 separating them will also be easily removed by the workman, by use of a chisel, screwdriver, manual twisting, etc. These plastic pieces 44 can also be removed (and similarly discarded) from the cap by having the bottom and tops of the knock-out pieces 30 provided with pre-scored and/or weakened lines extending across and between the top of a first pair of opposed slots 32 and 34, with score or weakened lines also provided to the immediately adjacent and bottom portion of the opposed pair of slots 32, 34 of another knock-out tab 30, located just above the first knock-out tab 30.

In the preferred embodiment, the width of the cap, from edge to edge is slightly less or substantially the same as the width of the face of the vertical post P upon which the cap is intended to be placed. The length of the cap, from top edge 26 to bottom edge 28 is preferably about the distance between brackets for the desired shelving of the metallic shelving system. It is expected that one of such caps (per post) will be secured above the bracket for the shelf of the metallic shelving system and one of such caps (also per post) will be secured below the bracket for the shelf of the system. In this manner, substantially all of the holes of the gondola standard (or post P) of the metallic shelving system are closed off by the gondola standard cap and its remaining knock-out tabs which overlay the otherwise open holes of the post (except for those knock-out tabs 30 which are deliberately removed from the cap to allow for the tabs of the bracket to pass therethrough and into the holes of the posts). This blockage of substantially all holes of the posts P is the desired goal of the present invention and is believed to result in fewer injuries to consumers and workers and to also minimizes debris from entering into the hollow channel of the posts. The cap also provides a finished and attractive look to an otherwise industrial looking set of metallic shelves. The caps can be made in a variety of colors and the color can serve as a means for organizing the rows of shelves within a store or warehouse.

The rear of the cap 10 is provided with two sets of aligned ears 60 and 62. Preferably, ear set 60 is located close to the top edge 26 of the cap while ear set 62 is located near to the bottom edge 28 of the cap. It will be appreciated that as a consequence of the construction of metallic shelving systems, the ear set 60 is preferably closer to the top edge 26 than ear set 62 is to the bottom edge 28, although such dimensioning is variable and depends upon the metallic shelving system for which the caps are intended to be utilized.

Looking at the rear or back 16, seen best in FIG. 2, the two sets of aligned yet opposed sets of ears 60 and 62, can be seen. Each ear set is substantially the same as the other so that description of one ear set satisfies the description of the other ear set. Each ear set is comprised of a spaced and opposed set of rearwardly extending flanges 70. The flanges 70 extend perpendicularly from the rear or back 16 of the cap 10. Although it is preferred that the ear sets are integrally formed and molded with the overall manufacture of the cap 10, it is within the contemplation of the present invention for the ear sets to be formed separately and then secured to the rear of the cap, by adhesive, melting, or mechanical connection between the flanges and the rear of the cap.

Further looking at FIG. 3, extending further rearwardly from the back 16 and secured or extending rearwardly from the opposed flanges are a pair of opposed, partially cylindrical members 80 and 82. These members define a cylindrical diameter of space between them, 84. The opposed flanges and members define a pair of opposed, vertical finger elements 90 and 92 which are resilient (at the flanges' connection to the rear of the cap) so that the space distance 84 between the fingers can be temporarily decreased as the ears (and members) are pushed through the holes of the post P and, yet, because of the resiliency, the space distance 84 will be reassumed by the opposed flanges and members when the inward pressure of the side walls of the hole into which the ear set is placed is released, a consequence of the further inward movement of the ear set into the holes of the post. The rearward extension of the flanges is such that the cap, when installed on a face of a post P, will have the opposed side edges of the cap just slightly separated or abutting the face of the post, with the ears, members and opposed fingers located behind the thickness of the face of the post and within the hole formed by the post.

The flanges will be located between the inside edges of the hole into which the ears have been pushed.

The outside and outwardly curved surface of the fingers 94 and 96 cam the fingers inwardly by the pressure and coacting of the inside walls of the hole and allow the cap to be placed such that its back 16 is basically flush upon the face of the post P. When so located and In this manner, the resiliency of the flanges 70 allow for the inwardly camming of the fingers and the subsequent capture of the ear sets within the holes of the post as the ears move first inwardly and then as the sides of the hole are located at the narrower section of the ears, i.e., when the flanges are located between the side walls of the hole of the post the resiliency of the ears causes them to pop back open but with the ears within the hole of the post and the flat surface of the cap located flush on the face of the post. The smaller width or dimension of the outside of the flanges in comparison to the distance between the outsides of the fingers locates the cap and allows the ears to resiliently flex back to their original dimensional distance, with the ears within the hollow of the post and the flanges between the opposed side walls of the hole into which the ears have been inserted. While the resiliency of the flanges and their springing back to the original condition holds the device in place, the outside distance or spacing of the ears 100, when they are not compressed together, is greater than the width of the hole within which the ears are located.

The height or vertical dimension of the ear sets is slightly less than the height of a hole H so that the ear sets can be received within the aligned holes H of the post P when the front face of the cap is pushed with the rear face or back 16 becoming flush against the face of the post P. The ear sets are suitably vertically spaced apart to correspond to the spacing of holes H of the post P. In the preferred embodiment, there are about nineteen spaced holes H between the spaced holes within which the ear sets are to be located, when the cap 10 is pushed onto the face of the post P. Stated differently, the top set of ears 60 will be captured within spaced numbered hole corresponding to H #1, while the second or bottom set of ears 62 will be captured within spaced numbered hole corresponding to H#21, so that nineteen spaced holes H are between the ears 60 and 62. More than two sets of ears can, of course be located on the rear of the cap. The location of the ear sets is spaced to correspond to the spacing of the holes in the post. The ear sets can be located beneath and above the knock-out tabs, as shown in the Drawings, or can be integrated onto the back of one or more of the knock-out tabs and removed, with the tabs, if needed. It is within the preferred embodiment of the present invention that the sets of ears is preferably two but more ear sets can be provided to more firmly secure the cap to the face wall of the post. The minimum number of ear sets for securement of the cap to the face of a post is one.

In use, the vertical posts are set up by the workman/workmen. Trusses installed, if needed, to make the system sound and steady. Then, the caps are located on the opposed walls of the posts P with the ears of the caps 10 passing though the open holes of the post. As mentioned, the ears will first flex inwardly allowing them to pass into the holes of the post and then because of the resiliency of the flanges and the ears, they will flex outwardly to their original dimensions, with the cap thus located on the front face of the post.

Then, when the location of the brackets is determined, the builder will knock out the knock out tabs corresponding to the holes of the post where the tabs of the brackets will be located. In some situations, multiple, adjacent knock-out tabs will need to be removed because of the length of the tabs of the brackets. In some situations, the adjacent knock out tabs and the small rectangular areas between adjacent and vertically spaced tabs will also need to the removed and discarded. Of course, to ensure that the bracket is horizontal and the shelving even and steady, the same knock out tabs and rectangular pieces from each of the four posts should be removed. Then the brackets are installed by sliding their tabs through the now exposed holes of the cap and into the holes of the post. The brackets are thus secured and then the horizontal shelves placed upon the brackets.

With the caps in place, except for the locations where the knock-out tabs have been deliberately removed, the holes of the post are closed off by the cap and its remaining knock-out tabs. This provides a smooth, aethestic look, an elimination of injury, and removes possible contaminants from gaining access to the interior of the posts through otherwise open holes.

I claim:

1. A cap for a face of a gondola standard, said face having a plurality of vertically spaced holes for selective receipt of at least one bracket to form a support for a horizontally-spaced set of shelving, the cap comprising:

a substantially planar piece of molded material substantially corresponding in width dimension to a face of a gondola standard and having a plurality of vertically-spaced knock-out tabs corresponding in size and spacing to vertically spaced holes of said face of the gondola standard to allow connection of one or more horizontal shelves to the gondola standard through said knock-out tabs of said cap, and having at least one gondola securing mechanism secured to a rear of said molded material for capturing and securing said cap to said face of the gondola standard by having said mechanism frictionally held within at least one of said vertically spaced holes, wherein said gondola securing mechanism comprises a pair of rearwardly extending and opposed flanges and curved wall fingers extending towards one another which cam said mechanism into said at least one of said vertically spaced holes when said cap is pushed onto said face of said gondola standard until said opposed flanges are located between opposed walls of said at least one of said vertically spaced holes of said gondola standard into which said mechanism is pushed and the rear of said planar piece of molded material is substantially flush with the face of said gondola standard.

2. A cap as claimed in claim 1 wherein said at least one gondola securing mechanism on said rear of said molded material is comprised of at least two sets of said opposed flanges and curved wall fingers, for receipt into a pair of said vertically spaced holes.

3. A cap as claimed in claim 2 further comprising:

said at least two sets of said opposed flanges and curved wall fingers are vertically spaced and provided substantially at the ends of said cap.

4. A cap as claimed in claim 1 wherein said opposed flanges and curved wall fingers flex inwardly during insertion of said cap onto said face and then outwardly to their original dimensional spacing when said mechanism is fully engaged within said at least one of said vertically spaced holes of said gondola standard.

5. A cap as claimed in claim 1 wherein said material is molded from a resilient plastic.

6. A cap as claimed in claim 1 further comprising removable spaces on said piece of molded material between adjacent of said knock out tabs.

7. A cap as claimed in claim 6 wherein said removable spaces are defined by scored or weakened portions on a front of said cap.

8. A cap as claimed in claim 1 wherein said knock-out tabs are defined by sidewise, U-shaped slots passing through said cap.

9. A cap as clamed in claim 1 wherein said flanges are inwardly resilient.

10. A cap as claimed in claim 1 wherein the camming of said gondola securing mechanism is accomplished by the mechanical interaction of said opposed walls of the hole of said gondola standard into which said gondola securing mechanism is pushed and said curved wall fingers.

11. A safety cap for a vertical post of a metallic shelving system being formed by a set of vertical posts, each of said posts having vertically spaced holes for selective receipt of shelf-supporting, horizontal brackets, the safety cap comprising:

a) a flat plate defining a substantially flat surface defined to substantially cover both a vertical dimension of one of said vertical posts and said holes of said post along with substantially the width of one of said posts;

b) a series of spaced knock-out tabs defined in said flat surface and corresponding in size and location to at least some of said vertically spaced holes of one of said posts, the knock-out tabs being removable to allow connection of said brackets through said safety cap and to one of said vertical posts; and c) at least two vertically spaced apart, opposed sets of inwardly and outwardly resilient ears secured to the back of said flat surface, also corresponding in size and location to some of said holes of one of said posts, said ears being capable of passing through and securing a back of said flat surface to a face of one of said posts, wherein said surface is pushed onto the face of one of the vertical posts until each of said ears are cammed and frictionally held between opposed walls of one of the vertically spaced holes of said vertical post by said ears.

12. A cap as claimed in claim 11 further comprising a pair of smooth side edges.

13. A cap as claimed in claim 11 wherein each set of said ears comprises a pair of rearwardly extending flanges and a pair of curved wall fingers which are cammed by the mechanical interaction of said opposed walls of said holes of said post pushing inwardly on said curved wall fingers and when said rear of said flat surface is located adjacent said face of said post, said flanges returning to their original dimensional spacing and between the opposed walls of said holes of said post into which said ears are located.

14. A cap as claimed in claim 11 wherein said knock-out tabs are defined by a pair of sidewise opposed U-shaped slots passing through said flat plate.

15. A cap as claimed in claim 14 wherein said slots are defined by scored or weakened areas of said flat plate.

16. A cap as claimed in claim 14 wherein spaces in between adjacent of said knock-out tabs are removable from said flat plate.

17. A cap as claimed in claim 16 wherein said spaces are defined by scored or weakened areas connecting said U-shaped slots.

18. A cap as claimed in claim 11 formed from plastic molding.

* * * * *